United States Patent [19]

Satake et al.

[11] Patent Number: 4,644,375

[45] Date of Patent: Feb. 17, 1987

[54] HEAT-SENSITIVE RECORDING SHEET

[75] Inventors: Toshimi Satake; Toshiaki Minami; Kazuo Maruyama; Fumio Fujimura, all of Tokyo, Japan

[73] Assignee: Jujo Paper Co., Ltd., Tokyo, Japan

[21] Appl. No.: 763,045

[22] Filed: Aug. 6, 1985

[30] Foreign Application Priority Data

Aug. 23, 1984 [JP] Japan ..... 59-175374

[51] Int. Cl.[4] ..... B41M 5/18

[52] U.S. Cl. ..... 346/209; 346/208; 346/216; 346/225; 427/150

[58] Field of Search ..... 346/208, 209, 216, 217, 346/221, 225; 427/150, 151, 152

[56] References Cited

U.S. PATENT DOCUMENTS 4,446,209 5/1984 Iwakura et al. ..... 346/216
4,480,052 10/1984 Ichijima et al. ..... 346/209

FOREIGN PATENT DOCUMENTS 0079996 5/1985 Japan ..... 346/209
85/01699 4/1985 PCT Int'l Appl. ..... 346/208
2142630A 1/1985 United Kingdom ..... 346/216

*Primary Examiner*—Bruce H. Hess

*Attorney, Agent, or Firm*—Koda and Androlia

[57] ABSTRACT

Heat-sensitive recording sheet comprising in a heat-sensitive color forming layer a colorless basic dyestuff and 4-isopropoxy-4'-hydroxydiphenyl sulfone as organic developer, wherein said color forming layer contains as sensitizer one of the compounds represented by the following formula (II) or (III):

(II)

(III)

where, in the general formula (II) and (III), A represents a hydrogen atom, halogen atom, nitro group, lower alkyl group, lower alkoxy group or hydroxy group, l represents an integer from 1 to 5 and m represents an integer from 0 to 3. The sheet provides high density images and excellent stability of images.

3 Claims, No Drawings

HEAT-SENSITIVE RECORDING SHEET

BACKGROUND OF THE INVENTION

1. Field of the Invention

This invention concerns a heat sensitive recording sheet which is suitable to high density and high speed recording and excellent in the storage stability of images.

2. Prior Art

Generally, heat sensitive recording sheet is prepared by usually grinding to disperse usually colorless or pale colored basic dye and a developer such as of phenolic substance into fine particles respectively, mixing them, adding binder, filler, sensitivity improver, lubricant and like other auxiliary agents thereto and coating the thus obtained coating liquid to paper, film or like other support, for obtaining color-forming recording through instantaneous chemical reaction upon heating. In this case, colors of various hues can be formed by selecting the kind of colorless dyes.

While a lot of substances are described as the developer for heat sensitive recording sheet in various literatures including Japanese Patent Publication No. 14039/1970, 4,4'-isopropylidene diphenol (bisphenol A) has most widely been utilized so far in view of the stability of the quality, cost and availability. However, bisphenol A has a defect in that the thermal color forming temperature is high and can not be adapted sufficiently to the recording with a minor heat energy and that troubles such as sticking have been liable to occur.

In recent years, higher speed recording and improvement in the image quality have been demanded for the heat sensitive recording sheet, and in compliance therewith, the present applicant has already proposed a heat sensitive recording sheet using p-hydroxy benzyl benzoate as the developer, which is combined with a fluoran type dye (refer to Japanese Patent Laid-Open No. 144193/1981), and made it clear that in improvement in the sensitivity with excellent dynamic color-forming property can be attained with ease. However, heat sensitive recording p-hydroxy benzyl benzoate as the developer has a problem in that the density of images formed by the heat application is reduced with the elapse of time, or p-hydroxy benzyl benzoate melted once by the application of heat causes recrystallization with the elapse of time to produce white powder on the surface of the images.

SUMMARY OF THE INVENTION

It is a general object of this invention to provide a heat sensitive recording sheet having a sufficient dynamic color forming density, excellent in the long time storage of the recorded images and, particularly, excellent image stability of showing no discoloration in the recorded images due to moisture, heat, etc. and causing no background fogging.

The above-mentioned object can be performed by using 4-isopropoxy-4'-hydroxydiphenylsulfone of the following general formula (I) as an organic developer and incorporating, as a sensitiser, at least one of the compounds represented by the following general formula (II) or (III):

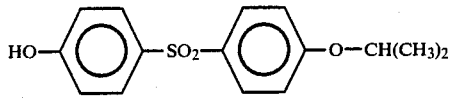

(I)

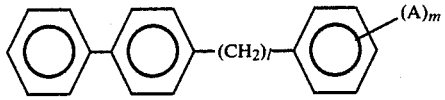

(II)

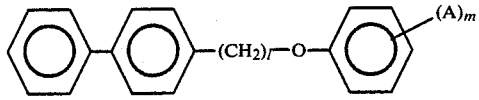

(III)

where, in the general formula (II) and (III), A represents a hydrogen atom, halogen atom, nitro group, lower alkyl group, lower alkoxy group or hydroxy group, l represents an integer from 1 to 5 and m represents an interger from 0 to 3.

In the description just mentioned for the general formula (II) and (III), the term "lower" for defining the alkyl group and the alkoxy group usually represents those groups containing from 1 to 5 carbon atoms. The lower alkyl group can include, for example, methyl group, ethyl group, n-propyl group, isopropyl group, n-butyl group, sec-butyl group and tert-butyl group, as well as the lower alkoxy group can include, for example, methoxy group, ethoxy group, n-propoxy group, isopropoxy group, n-butoxy group, sec-butoxy group or tert-butoxy group.

DETAILED DESCRIPTION OF THE INVENTION 4-isopropoxy-4'-hydroxydiphenyl sulfone as the organic developer for use in this invention is a compound with a melting point from 129°–130° C. When known sensitizer, for example, stearic amide, P-benzyloxy benzyl benzoate, dibenzyl terephthalate, di-p-tolyl carbonate and the like is used as the sensitizer to the color developing agent, it is difficult to effectively improve the dynamic color-forming property thereof. While on the other hand, the dynamic color-forming property can outstandingly be improved by the use of a sensitizer represented by the general formula (II) or (III) according to this invention.

This is due to the fact that the developer 4-isopropoxy-4'-hydroxy diphenyl sulfone has a high melting, dissolving and diffusion speed, as well as a great and saturation solubility to the synthetizer according to this invention.

That is, it is considered that the sensitizer represented by the general formula (II) or (III) has an extremely good compatibility with 4-isopropoxy-4'-hydroxy diphenyl sulfone. These sensitizers are also excellent in the compatibility with the colorless basic dye.

Specific examples for the sensitizer shown by the general formula (II) and (III) used in this invention will now be described later.

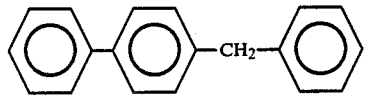

(1)

-continued (2)

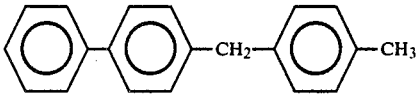

(3)

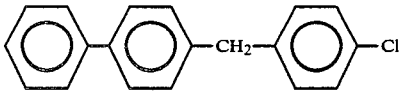

(4)

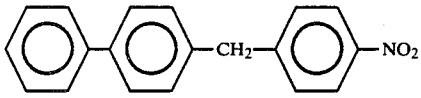

(5)

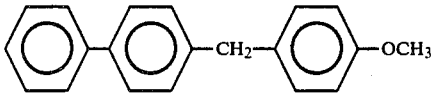

(6)

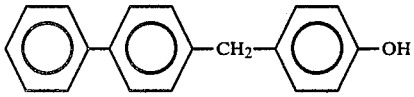

(7)

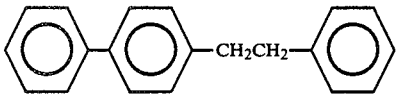

(8)

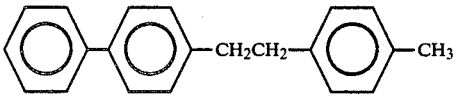

(9)

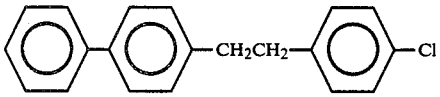

(10)

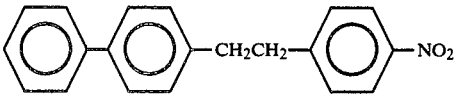

(11)

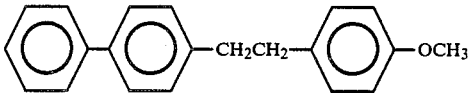

(12)

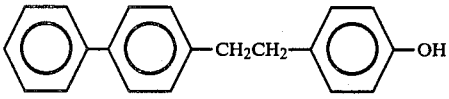

(13)

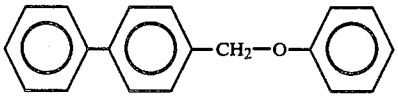

(14)

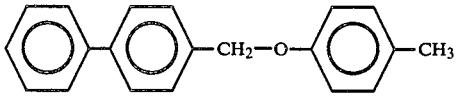

(15)

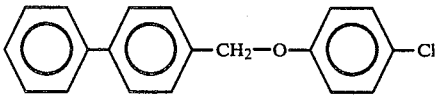

-continued (16)

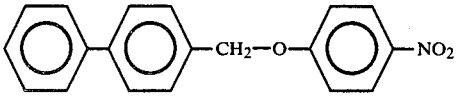

(17)

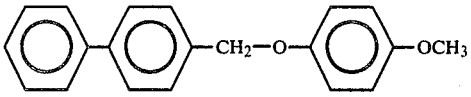

(18)

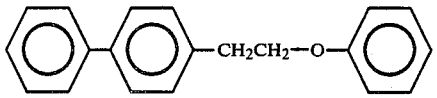

(19)

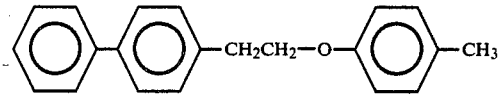

(20)

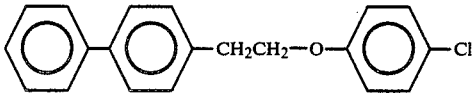

(21)

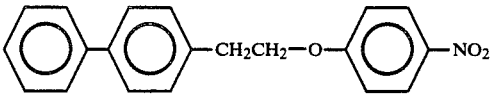

(22)

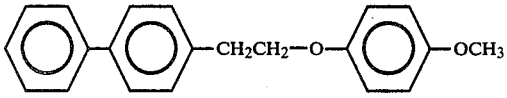

The above color-developing agents may be used either alone or in combination.

In the present invention, it is required to use 10–100 weight-% of sensitizer of the general formula (II) or (III) per 4-isopropoxy-4'-hydroxydiphenyl sulfone as organic binder. When the amount of the sensitizer is lower than 10 weight-%, the effect is poor, and when the amount of the sensitizer is higher than 100 weight-% the coloring density is low due to the dilution of the organic color-developing agent.

On the other hand, the species of the basic colorless dyestuffs of the present invention is not otherwise limited and it is preferable to use triphenylmethane dyestuffs, fluoran dyestuffs, azaphthalide dyestuffs, etc.

Examples of such dyestuffs are as follows:

Triphenylmethane dyestuffs 3,3-bis(p-dimethylaminophenyl)-6-dimethylaminophthalide (crystal violet lactone)

Fluoran dyestuffs 3-diethylamino-6-methyl-7-anilinofluoran
3-(N-ethyl-p-toluidino)-6-methyl-7-anilinofluoran
3-(N-ethyl-N-isoamyl)amino-6-methyl-7-anilinofluoran
3-diethylamino-6-methyl-7-(O,P-dimethylanilino)fluoran
3-pyrolidino-6-methyl-7-anilinofluoran
3-pyperidino-6-methyl-7-anilinofluoran
3-(N-cyclohexyl-N-methylamino)-6-methyl-7-anilinofluoran
3-diethylamino-7-(m-trifluoromethylanilino)fluoran
3-dibutylamino-7-(o-chloroanilino)fluoran 3-diethylamino-6-methyl-chlorofluoran
3-diethylamino-6-methyl-fluoran
3-cyclohexylamino-6-chlorofluoran
3-diethylamino-7-(o-chloroanilino)fluoran
3-diethylamino-benzo[a]-fluoran Azaphthalide dyestuffs 3-(4-diethylamino-2-ethoxyphenyl)-3-(1-ethyl-2-methylindole-3-yl)-4-azaphthalide
3-(4-diethylamino-2-ethoxyphenyl)-3-(1-ethyl-2-methylindole-3-yl)-7-azaphthalide
3-(4-diethylamino-2-ethoxyphenyl)-3-(1-octyl-2-methylindole-3-yl)-4-azaphthalide
3-(4-N-cyclohexyl-N-methylamino-2-methoxyphenyl)-3-(1-ethyl-2methylindole-3-yl)-4-azaphthalide The above dyestuffs may be used either alone or in combination. The solely use of the basic dyestuff, such as 3-diethylamino-6-methyl-7-anilinofluoran, 3-(N-cyclohexyl-N-methylamino)-6-methyl-7-anilinofluoran, 3-(N-ethyl-N-isoamyl)amino-6-methyl-7-anilinofluoran or 3-(4-diethylamino-2-ethoxyphenyl)-3-(1-ethyl-2-methylindole-3-yl)-4-azaphthalide, provides a heat-sensitive recording sheet with a remarkably high dynamic image density.

The combined use of 3-diethylamino-6-methyl-7-anilinofluoran with 3-(N-cyclohexyl-N-methylamino)-6-methyl-7-anilinofluoran provides a heat-sensitive recording sheet having a remarkably high dynamic image density, a superior oil-resistance and an improved stability in preserving.

The organic color-developer and the colorless basic dyestuff, as well as the sensitizer as mentioned above are finely pulverized in a grinder such as ball mill, an attritor, a sand grinder or the like, or in an appropriate emulsifying apparatus into fine particles of less than several micron particle size and incorporated with various type of additives depending on the purposes to prepare a coating solution. Other color developers may be added in an amount which does not deteriorate the effects of the present invention. The coating solution may usually be incorporated with binders such as polyvinyl alcohol, modified polyvinyl alcohol, hydroxyethylcellulose, methylcellulose, starches, styrene-maleic anhydride copolymer, vinylacetate-maleic anhydride copolymer and styrenebutadiene copolymer, as well as organic or inorganic filler such as kaolin, calcined kaolin, diatomaceous earth, talc, titanium oxide, calcium carbonate, magnesium carbonate and aluminum hydroxide. In addition, releasing agent such as metal salt of fatty acid, lubricant such as waxes, UV-absorber of benzophenone or triazole type, water-proofing agent such as glyoxal, dispersant, defoamer, mottling preventing agent (e.g. fatty acid amide, ethylene bisamide, montan wax, polyethylene wax), stabilizer (e.g. metal salt of phthalic acid monoester, metal p-tert-butylbenzoate, metal nitrobenzoate) or the like can also be used. By coating the solution on a substrate, such as paper or various types of films, aimed heat-sensitive recording sheets can be obtained.

The effects of the present invention are as follows.

(1) Since the heat responsibility is excellent, clear high density images can be obtained also in high speed and high density recording.

(2) Recorded images are excellent in the long-time storability and, particularly, show no discoloration due to moisture or heat.

(3) There is scarce aging coloration in the background area.

The kind and the amount of the organic developer, colorless basic dye, sensitizer and various other ingredients used in this invention are determined depending on the required performance and the recording adaptability and, while there are no particular restrictions, it is suitable to use from 3 to 12 parts of 4-isopropoxy-4'-hydroxydiphenyl sulfone as the organic developer, from 3 to 12 parts of the sensitizer and from 1 to 20 parts of the filler based on one part of the colorless basic dye, and from 10 to 25 parts of the binder in the total solids.

This invention will now be described specifically, referring to typical examples.

(EXAMPLE 1)

| | |
|---|---|
| Solution A (dye dispersion liquid) | |
| 3-diethylamino-6-methyl-7-anilinofluoran | 2.0 part |
| 10% aqueous solution of polyvinyl alcohol | 4.6 part |
| Water | 2.5 part |
| Solution B (developer dispersion liquid) | |
| 4-isopropoxy-4'-hydroxydiphenyl sulfone | 6 part |
| Zinc stearate | 1 part |
| 10% aqueous solution of polyvinyl alcohol | 29.5 part |
| Water | 5.6 part |
| Solution C (sensitizer dispersion liquid) | |
| P—benzylbiphenyl | 4 part |
| 10% aqueous solution of polyvinyl alcohol | 5 part |
| Water | 3 part |

Each of the solutions having the above-composition was grounded by an attritor into particle size of 3 μm.

Then, the dispersion liquids were mixed in the ratio described below into a coating solution.

| | |
|---|---|
| Solution A (dye dispersion liquid) | 9.1 part |
| Solution B (developer dispersion liquid) | 42 part |
| Solution C (sensitizer dispersion liquid) | 12 part |
| Kaolin clay (50% dispersion liquid) | 20 part |

The coating solution as described above was coated and dried on one surface of a substrate paper of 50 $g/m^2$ so as to obtain about 6.0 $g/m^2$ of the coating amount. The coated paper sheets were processed in a super calendar so as to obtain a smoothness of 200–600 seconds. The quality performance test was carried out for the thus obtained heat sensitive recording paper and the results are shown in Table 1.

(Comparative Example 1)

Heat sensitive recording paper was prepared in the same manner as in Example 1 without using the solution C as used in Example 1. The results of the quality performance test are shown in Table 1.

(Comparative Example 2)

Solution D (sensitizer dispersion liquid)

| | |
|---|---|
| Sensitizer (refer to Table 1) | 4 part |
| 10% aqueous solution of polyvinyl alcohol | 5 part |
| Water | 3 part |

Heat sensitive recording paper was prepared in the same manner as in Example 1 except for using the solution D processed in the attritor in place of the solution C. The results for the quality performance test are shown in Table 1.

(Comparative Example 3)

Solution E (developer dispersion liquid)

| | |
|---|---|
| Bisphenol A | 6 part |
| Zinc stearate | 1 part |
| 10% aqueous solution of polyvinyl alcohol | 29.5 part |
| Water | 5.5 part |

The solution E as described above processed in the attritor and the solutions A and C used in Example 1 were mixed in the ratio as below into a coating solution.

| | |
|---|---|
| Solution A (dye dispersion liquid) | 9.1 part |
| Solution E (developer dispersion liquid) | 42 part |
| Solution C (sensitizer dispersion liquid) | 12 part |
| Kaolin clay (50% dispersion liquid) | 20 part |

Heat sensitive recording paper was prepared in the same manner as in Example 1 using the above-mentioned coating solution and the quality performance test was carried out. The results are shown in Table 1.

(Comparative Example 4)

Heat sensitive recording paper was prepared in the same manner as in Example 3 without using the solution C as used in Comparative Example 3. The results of the quality performance test are shown in Table 1.

TABLE 1

Test result for the quality performance

| | Test No. | Organic developer | Sensitizer | (1) Color forming density (2) Static | (3) Dynamic | (4) White paper storability (5) Moisture not-treated | (5) Moisture proofness | (6) Heat proofness | (7) Recording storability (8) Not-treated | (8) Moisture proofness | (9) Heat proofness |
|---|---|---|---|---|---|---|---|---|---|---|---|
| Example 1 | 1 | 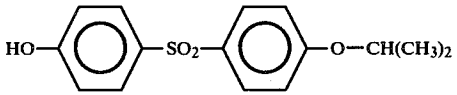 | 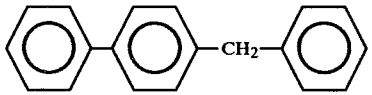 | 1.27 | 0.72 | 0.03 | 0.06 | 0.09 | 1.17 | 1.17 | 1.23 |
| Comparative Example 1 | 2 | 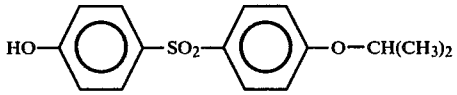 | none | 1.02 | 0.31 | 0.04 | 0.06 | 0.09 | 0.62 | 0.67 | 0.83 |
| Comparative Example 2 | 3 | 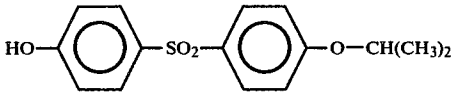 | stearic amide | 1.25 | 0.35 | 0.08 | 0.12 | 0.20 | 0.65 | 0.67 | 0.80 |
| | 4 | 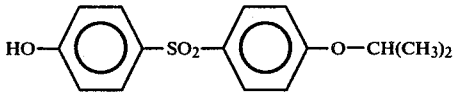 | 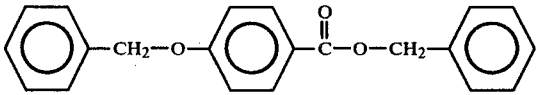 | 1.26 | 0.53 | 0.04 | 0.06 | 0.10 | 0.95 | 0.94 | 1.06 |
| | 5 | 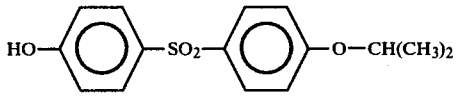 | 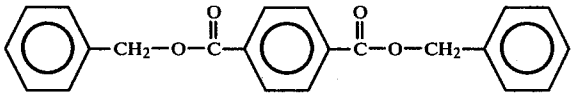 | 1.26 | 0.57 | 0.04 | 0.06 | 0.10 | 0.98 | 0.98 | 1.12 |
| | 6 | 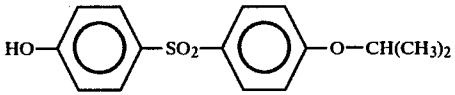 | 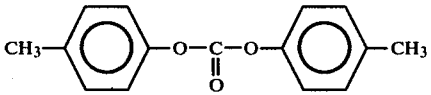 | 1.26 | 0.61 | 0.04 | 0.06 | 0.10 | 1.10 | 1.10 | 1.19 |
| Comparative Example 3 | 7 | 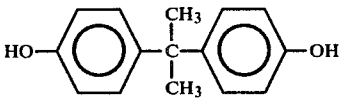 | 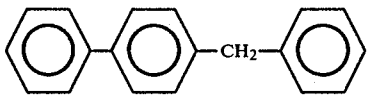 | 1.26 | 0.40 | 0.04 | 0.08 | 0.11 | 0.65 | 0.67 | 0.70 |

TABLE 1-continued
| | Test No. | Organic developer | Sensitizer | Test result for the quality performance | | | | | | | |
|---|---|---|---|---|---|---|---|---|---|---|---|
| | | | | (1) Color forming density | | (4) White paper storability | | | (7) Recording storability | | |
| | | | | (2) Static | (3) Dynamic | (5) Moisture not-treated | (5) Moisture proofness | (6) Heat proofness | (8) Not-treated | (8) Moisture proofness | (9) Heat proofness |
| Comparative Example 4 | 8 | 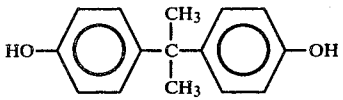 | none | 0.27 | 0.27 | 0.04 | 0.08 | 0.08 | 0.55 | 0.54 | 0.54 |

Note (1) Color forming density: Measured by Macbeth densitometer (RF-514, amber filter used, same in the followings)

Note (2) Static color forming density: Measured by a Macbeth densitometer for color by urging to a hot plate heated to 105° C. under the pressure of 10 g/m$^2$ for 5 sec.

Note (3) Dynamic color forming density: Measured by a Macbeth densitometer for the density of recorded images using a heat sensitive printing tester THP 8050 manufactured by ROHM at pulse width of 1.00 msec and application voltage of 16.5 V.

Note (4) White paper storbility: Measured by a Macbeth densitometer for not color-formed area.

Note (5) Moisture proofness: Background density after left for 24 hours at a highly humid condition of 40° C. and 90% RH.

Note (6) Heat proofness: Background density after left for 24 hours under high temperature and dry condition of 60° C.

Note (7) Recording storability: Measured by a Macbeth densitometer for recorded image density using a heat sensitive printing tester THP 8050 manufactured by ROHM, at pulse width of 1.24 msec and application voltage of 16.5 V.

Note (8) Moisture proofness: Image density after left for 24 hours under high humid condition of 40° C., 90% RH.

Note (9) Heat proofness: Image density after left for 24 hour under high temperature and dry condition of 60° C.

From Table 1, it can be seen that the examples of this invention in which 4-isopropoxy-4'-hydroxydiphenyl sulfone used as a developer and p-benzylbiphenyl is added in are the heat sensitive recording layer show high dynamic color forming density and are excellent in the white paper storability and recording storability.

We claim:

1. A heat-sensitive recording sheet comprising a substrate and a heat-sensitive color forming layer formed on at least one surface of said substrate, and said heat-sensitive color forming layer comprising a colorless basic dyestuff and an organic developer as the essential ingredient, wherein 4-isoproxy-4'-hydroxydiphenyl sulfone represented by the following general formula (I) is contained as said organic developer, and said heat sensitive color forming layer contains as a sensitizer at least one of the compounds represented by the following general formula (II) or (III):

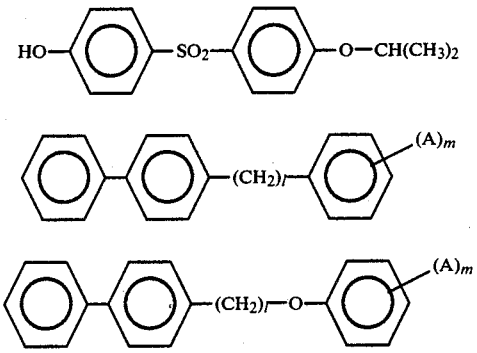

(I)

(II)

(III)

wherein, in the general formula (II) and (III), A represents a hydrogen atom, halogen atom, nitro group, lower alkyl group, lower alkoxy group or hydroxy group, l represents an integer from 1 to 5 and m represents an integer from 0 to 3.

2. A heat-sensitive recording sheet according to claim 1, wherein said sensitizer of the formula (II) or (III) is used in amount of 10 to 100% by weight on dry basis with respect to 4-isopropoxy-4'-hydroxydiphenyl sulfone.

3. A heat-sensitive recording sheet according to claim 1 or 2, wherein said heat-sensitive color forming layer comprises 3–12 parts by weight of 4-isopropoxy-4'-hydroxydiphenyl-sulfone as organic developer, 3–12 parts by weight of said sensitizer and 1–20 parts by weight of filler based on one part by weight of said colorless basic dyestuff, and 10–25 parts by weight of binder in the total solids.

* * * * *